US011268481B2

(12) United States Patent
Itagaki

(10) Patent No.: US 11,268,481 B2
(45) Date of Patent: Mar. 8, 2022

(54) INTAKE MANIFOLD STRUCTURE

(71) Applicant: HONDA MOTOR CO., LTD., Tokyo (JP)

(72) Inventor: Keisuke Itagaki, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/106,918

(22) Filed: Nov. 30, 2020

(65) Prior Publication Data

US 2021/0172411 A1 Jun. 10, 2021

(30) Foreign Application Priority Data

Dec. 5, 2019 (JP) ..... JP2019-220629

(51) Int. Cl.
*F02M 26/44* (2016.01)
*F02M 26/20* (2016.01)
(Continued)

(52) U.S. Cl.
CPC ..... *F02M 35/112* (2013.01); *F02M 26/20* (2016.02); *F02M 26/44* (2016.02); *F02M 35/10222* (2013.01)

(58) Field of Classification Search
CPC .. F02M 35/10222; F02M 25/06; F02M 26/20; F02M 26/44
See application file for complete search history.

(56) References Cited

U.S. PATENT DOCUMENTS 1,768,136 A * 6/1930 Moorhouse ..... F02M 63/00 123/184.39
5,642,695 A * 7/1997 Spies ..... F02M 35/10216 123/142.5 E
(Continued)

FOREIGN PATENT DOCUMENTS

DE 10045636 A1 * 3/2002 ..... F02M 35/10052
JP 2003074430 A 3/2003
(Continued)

OTHER PUBLICATIONS

English Machine translation of Description provided by ESPACENET of JP 2011080394 A (Year: 2021).*
(Continued)

*Primary Examiner* — Michael A Kessler
(74) *Attorney, Agent, or Firm* — Armstrong Teasdale LLP

(57) ABSTRACT

Provided is an intake manifold structure for an internal combustion engine including an intake manifold defining a plurality of branch passages (13) communicating with corresponding intake ports (6) of the internal combustion engine (1) arranged in a cylinder row direction thereof, and provided with additional gas introduction ports (29) communicating with the respective branch passages, and an additional gas introduction passage forming member (16) attached to the intake manifold, and defining an additional gas inlet (35) and additional gas introduction passages (14) communicating the additional gas inlet with the corresponding additional gas introduction ports, wherein the additional gas introduction passage forming member extends across the branch passages, and is provided with a guide wall (33) for defining the additional gas introduction passages in cooperation with an outer surface of the intake manifold and an inner surface of the additional gas introduction passage forming member.

7 Claims, 4 Drawing Sheets

(51) Int. Cl.
*F02M 35/112* (2006.01)
*F02M 35/10* (2006.01)

(56) References Cited

U.S. PATENT DOCUMENTS

| | | | | | |
|---|---|---|---|---|---|
| 5,642,697 | A * | 7/1997 | Jahrens | F02M 35/1036 | 123/184.21 |
| 2006/0191505 | A1* | 8/2006 | Doko | F02M 35/10347 | 123/184.59 |
| 2013/0118433 | A1* | 5/2013 | Tochizawa | F02M 35/10222 | 123/184.21 |
| 2014/0014056 | A1* | 1/2014 | Sato | F02M 26/41 | 123/184.47 |

FOREIGN PATENT DOCUMENTS

| | | | | |
|---|---|---|---|---|
| JP | 2005098164 | A * | 4/2005 | |
| JP | 2011080394 | A | 4/2011 | |
| JP | 2014040801 | A * | 3/2014 | |
| JP | 2014137048 | A * | 7/2014 | |
| JP | 2014173578 | A * | 9/2014 | F02M 35/104 |
| JP | 2016191363 | A | 11/2016 | |
| JP | 6665547 | B2 * | 3/2020 | |

OTHER PUBLICATIONS

English Machine translation of Description provided by ESPACENET of JP 2003074430 A (Year: 2021).*
JPO Office Action for Patent Application JP 2019-220629 dated May 11, 2020; 3 pp.

* cited by examiner

INTAKE MANIFOLD STRUCTURE

TECHNICAL FIELD

The present invention relates to an intake manifold structure for an internal combustion engine.

BACKGROUND ART

A known intake manifold structure disclosed in JP2016-191363A includes an intake manifold internally defining a plurality of branch passages, EGR passages for recirculating EGR gas to the branch passages, and blow-by gas passages for recirculating blow-by gas to the branch passages. In this intake manifold structure, the EGR passages and the blow-by gas passages extend across the branch passages. The inlets to the EGR passages and the blow-by gas passages are formed in either end of the intake manifold along the cylinder row direction. The outlets of the EGR passages and the blow-by gas passages are located so as to centrally align with the corresponding branch passages.

It is desirable to evenly distribute the EGR gas and the blow-by gas among the different cylinders for a smooth and efficient operation of the internal combustion engine. However, according to this prior art, the distances between the EGR inlet and the EGR outlets of the EGR passages vary from one EGR passage to another. The same is true with the blow-by gas passages. Therefore, the EGR gas and the blow-by gas are not likely to be evenly distributed.

SUMMARY OF THE INVENTION

In view of such a problem of the prior art, a primary object of the present invention is to provide an intake manifold structure including an intake manifold having passages for distributing additional gas such as blow-by gas and EGR gas to the branch passages of the intake manifold in such a manner that the additional gas can be evenly distributed among the different branch passages.

To achieve such an object, the present invention provides an intake manifold structure for an internal combustion engine including an intake manifold defining a plurality of branch passages (13) communicating with corresponding intake ports (6) of the internal combustion engine (1) arranged in a cylinder row direction thereof, and provided with additional gas introduction ports (29) communicating with the respective branch passages, and an additional gas introduction passage forming member (16) attached to the intake manifold, and defining an additional gas inlet (35) and additional gas introduction passages (14) communicating the additional gas inlet with the corresponding additional gas introduction ports, wherein the additional gas introduction passage forming member extends across the branch passages, and is provided with a guide wall (33) for defining the additional gas introduction passages in cooperation with an outer surface of the intake manifold and an inner surface of the additional gas introduction passage forming member.

The guide wall allows the additional gas introduction passages to be formed in a desired configuration in cooperation with the outer surface of the intake manifold and the inner surface of the additional gas introduction passage forming member so that the additional gas can be distributed to the different branch passages in a highly even manner. The outer wall of the additional gas introduction passage forming member may also define a part of the additional gas introduction passages in cooperation with the guide wall.

Preferably, the additional gas inlet is formed in an end part of the additional gas introduction passage forming member along the cylinder row direction, and an inlet chamber (34A) directly communicating with the additional gas inlet and having a certain volume is defined by the guide wall in cooperation with an outer wall of the additional gas introduction passage forming member.

The inlet chamber serves as a surge tank for suppressing the pulsation of the additional gas flow, and can be formed by the guide wall in cooperation with an outer wall of the additional gas introduction passage forming member without requiring any additional components or complicating the intake manifold structure.

Preferably, the guide wall includes a central opening located in a central part of the additional gas introduction passage forming member along the cylinder row direction, and communicating a downstream end of the inlet chamber with a part of the additional gas introduction passages leading to the respective additional gas introduction ports.

By thus providing the central opening between the downstream end of the inlet chamber and the part of the additional gas introduction passages located downstream thereof, the additional gas can be distributed among the different additional gas introduction ports in a particularly favorable manner.

Preferably, a tubular projection projects from a periphery of the central opening in a downstream direction.

Thereby, the flow direction of the additional gas is directed in a direction orthogonal to the cylinder row direction so that the even distribution of the additional gas to the different passages can be ensured.

Preferably, a downstream chamber (34B) is defined between the outer wall of the additional gas introduction passage forming member and the guide wall in a region located between the additional gas inlet and the central opening, and between the outer wall of the additional gas introduction passage forming member and the outer surface of the intake manifold in a region located between the central opening and an end part of the additional gas introduction passage forming member remote from the additional gas inlet.

Thereby, the downstream chamber that provides the additional gas flow passage between the central opening and the different additional gas introduction ports can be formed with a simple structure. In particular, since the downstream chamber consists of a single chamber without any partition wall, the structure can be particularly simplified. When this structure is combined with a projecting wall projecting from the part of the intake manifold located between the adjoining additional gas introduction ports, an even distribution of the additional can be achieved in a particularly favorable manner by using a highly simple structure.

Preferably, a projecting wall projects from the part of the intake manifold located between the adjoining additional gas introduction ports.

Thereby, the distribution of the additional gas between the adjoining gas introduction ports can be accomplished in an even more favorable manner.

Preferably, a wall part of the additional gas introduction passage forming member adjoining the additional gas inlet bulges away from the outer surface of the intake manifold.

Thereby, the volume of the inlet chamber can be increased with a minimum increase in the size of the additional gas introduction passage forming member.

Preferably, a central part of the additional gas introduction passage forming member along the cylinder row direction substantially coincides with a central part of the intake manifold along the cylinder row direction.

Thereby, the additional gas can be distributed to the different branch passages in an even manner by using a highly simple structure.

Preferably, the additional gas introduction ports are formed in wall parts of the intake manifold located between adjoining branch passages in a pair so to communicate with the adjoining branch passages, respectively.

Thereby, the particular additional gas introduction passage communicating with the adjoining branch passages can be bifurcated at the region located between the adjoining branch passages so that the additional gas can be distributed evenly between the adjoining branch passages without complicating the structure of the additional gas introduction passage forming member.

It is particularly important to arrange the intake manifold structure in such a manner that flow paths extending from the central opening to the respective additional gas introduction ports are substantially identical to one another.

Preferably, the intake manifold curves around the cylinder row direction so as to face a convex side thereof away from a main body of the internal combustion engine, and the additional gas introduction passage forming member is attached to an outer side of a part of the intake manifold adjoining the intake ports.

Thereby, the additional gas can be injected into the parts of the branch passages near the corresponding intake ports, and the additional gas introduction passage forming member can be positioned in a recessed part of the internal combustion engine so that the outer profile of the internal combustion engine can be kept compact in spite of the presence of the additional gas introduction passage forming member.

Thus, the present invention provides an intake manifold structure including an intake manifold having passages for distributing additional gas such as blow-by gas and EGR gas to the branch passages of the intake manifold in such a manner that the additional gas can be evenly distributed among the different branch passages.

BRIEF DESCRIPTION OF THE DRAWING(S)

DESCRIPTION OF THE PREFERRED EMBODIMENT(S)

An intake manifold structure for an internal combustion engine according to the preferred embodiment of the present invention is described in the following with reference to the appended drawings. The directions referred to in the following disclosure will be primarily based on the directions of a vehicle on which the internal combustion vehicle is mounted laterally.

Figure 1:
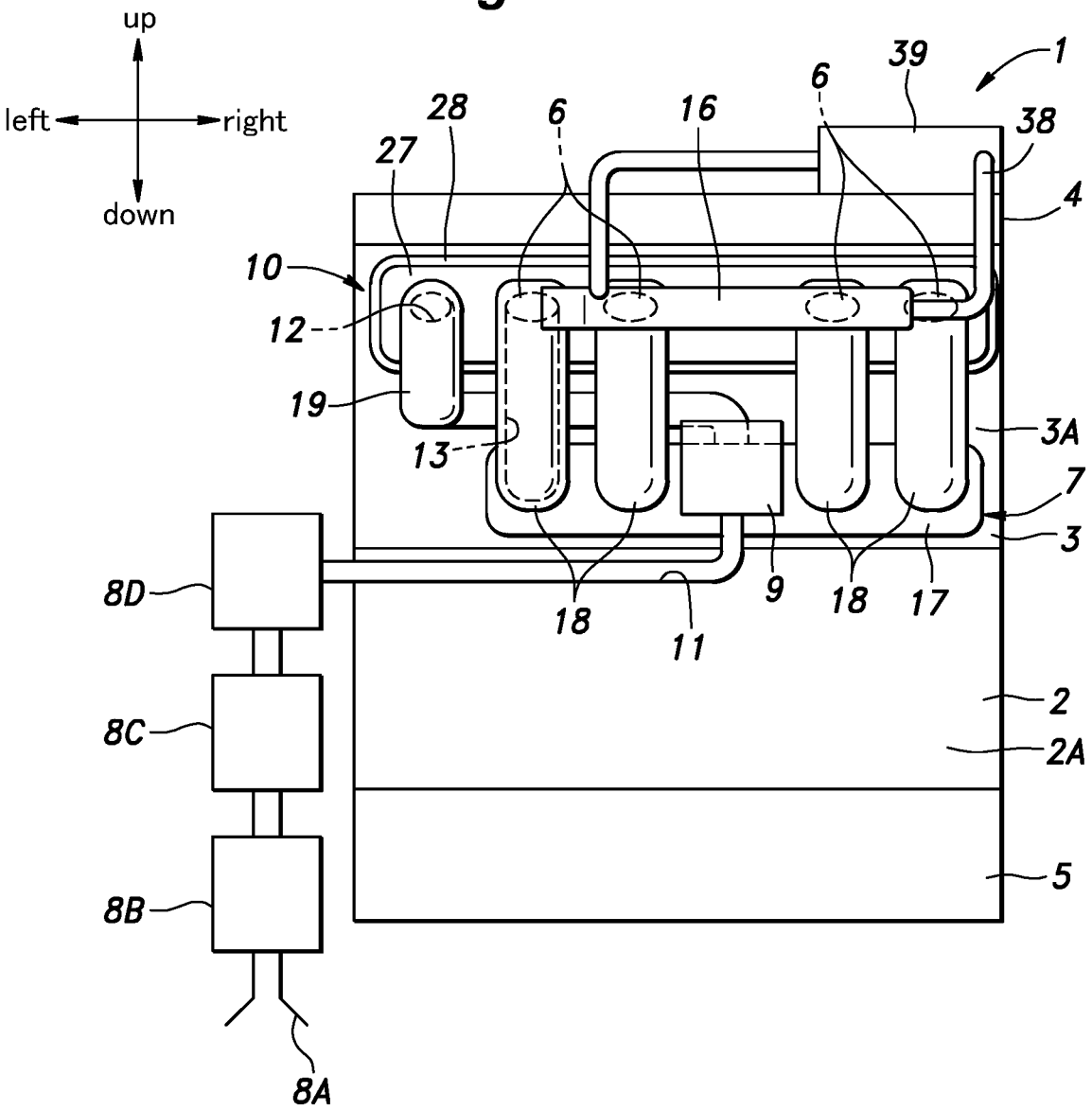
FIG. 1 is a schematic diagram of an internal combustion engine according to an embodiment of the present invention.

As shown in FIG. 1, the internal combustion engine 1 is an in-line four-cylinder reciprocating engine, and is provided with a cylinder block 2 having four cylinders defined therein, a cylinder head 3 connected to the upper end of the cylinder block 2, a head cover 4 connected to the upper end of the cylinder head 3, and an oil pan 5 attached to the lower end of the cylinder block 2. The internal combustion engine 1 is laterally mounted in the engine compartment of the vehicle with a slight rearward slant so that the cylinder row direction coincides with the lateral direction of the vehicle. The front side of the internal combustion engine is the exhaust side, and the rear side is the intake side, in the present embodiment. As can be appreciated by a person skilled in the art, the present invention can be equally applicable to the case where the intake side and the exhaust side are reversed.

Four combustion chamber recesses are formed on the lower surface of the cylinder head 3 to form combustion chambers in cooperation with the cylinders formed in the cylinder block 2. The cylinder head 3 is formed with intake ports 6 extending rearward from the corresponding combustion chamber recess, and opening on the rear surface 3A of the cylinder head 3. The cylinder head 3 is similarly formed with exhaust ports extending forward from the corresponding combustion chamber recesses, and opening on the front surface of the cylinder head 3 (although not shown in the drawings).

The intake ports 6 are arranged in the cylinder row direction (lateral direction) on the rear surface 3A of the cylinder head 3. An intake device 7 for supplying intake air to the combustion chambers is attached to the rear surface 3A of the cylinder head 3. The intake device 7 includes an air inlet 8A, an air cleaner 8B, a compressor 8C, an intercooler 8D, a throttle valve 9, and an intake manifold 10, in this order, and is connected to the intake ports 6 via branch passages 13 defined in the intake manifold 10. The intake device 7 defines an intake passage 11 that supplies air to the combustion chambers. The compressor 8C may be a part of a turbocharger or a supercharger.

In the present embodiment, a crankcase chamber opening 12 is provided in part of the rear surface 3A of the cylinder head 3 to the left of the leftmost intake port 6. The crankcase chamber opening 12 communicates with the crankcase chamber via a passage (not shown in the drawings) provided in the cylinder head 3 and the cylinder block 2. This passage conducts the blow-by gas generated in the crankcase chamber to the outside of the crankcase chamber. The intake manifold 10 is connected to the cylinder head 3 so as to cover all the intake ports 6 and the crankcase chamber opening 12 from the rear.

An exhaust device (not shown in the drawings) for expelling exhaust gas from the combustion chambers is attached to the front surface of the cylinder head 3. The exhaust device includes an exhaust manifold, a three-way catalyst, a muffler, etc. in this order from the upstream side, and is connected to the exhaust ports via exhaust passages defined in the exhaust manifold, in a per se known manner.

The intake manifold 10 is described in the following in more detail with reference to FIGS. 2 to 4. The intake manifold 10 internally defines the branch passages 13 communicating with the respective intake ports 6 as discussed earlier.

A cover member 16 elongated in the cylinder row direction is attached to a part of the intake manifold 10 adjacent to the intake ports 6, and extends across the branch passages 13. In this embodiment, the intake manifold 10 and the cover member 16 are made of two separate injection molded plastic components.

The intake manifold 10 includes a plenum chamber casing 17, a plurality of branch pipes 18 extending from the plenum chamber casing 17, and an auxiliary pipe 19. The plenum chamber casing 17 extends in a substantially linearly in the cylinder row direction (crank axial direction), and closed at both ends. The plenum chamber casing 17 is centrally provided with a short tubular portion defining an intake inlet 21 that opens substantially rearward. A fastening flange 26 is provided on the outer periphery of the free end of the short tubular portion. The throttle valve 9 is fastened to the fastening flange 26 so that the intake inlet 21 communicates with the outlet end of the throttle valve 9.

The branch passages 13 are defined by the respective branch pipes 18, and communicate with the plenum chamber defined by the plenum chamber casing 17. See FIG. 4. In this embodiment, the branch pipes 18 are four in number so as to corresponding to the respective intake ports and cylinders, and are arranged in the cylinder row direction. The branch pipes 18 may be named as the first branch pipe 18A, the second branch pipe 18B, the third branch pipe 18C, and the fourth branch pipe 18D, from left to right in FIG. 2.

The branch pipes 18 are arranged evenly along the cylinder row direction in the part thereof adjacent to the intake ports 6. However, in the part of the branch pipes 18 adjacent to the plenum chamber casing 17, the first branch pipe 18A and the second branch pipes 18B are placed closed to each other, and so is the third branch pipe 18C and the fourth branch pipe 18D. On the other hand, the second branch pipes 18B and the third branch pipe 18C are relatively spaced from each other. The short tubular portion defining the intake inlet 21 (as well as the throttle valve 9) is positioned in the space defined between the second branch pipes 18B and the third branch pipe 18C.

More specifically, the closely located branch pipes 18A and 18B, and 18C and 18D are connected to each other in such a manner that the two adjoining branch pipes 18A and 18B, and 18C and 18D share the wall, or the adjoining intake passages are separated from each other by a wall having the general wall thickness of branch pipes 18 in the part adjacent to the plenum chamber casing 17. On the other hands, in the part adjacent to the intake ports 6, the adjoining branch pipes are separated from each other by a connecting portion 20 which has a significantly greater wall thickness than the wall part separating the closely located branch pipes 18A and 18B, and 18C and 18D in the part thereof adjacent to the plenum chamber casing 17. In this embodiment, there are three connecting portions 20; the first connecting portion 20A connecting the first branch pipe 18A with the second branch pipe 18B, the second connection portion connecting the second branch pipe 18B with the third branch pipe 18C, and the third connecting portion 20A connecting the third branch pipe 18C with the fourth branch pipe 18D. Further, the first and second branch pipes 18A and 18B are located on one longitudinal end part of the plenum chamber casing 17 (along the cylinder row direction), and the third and fourth branch pipes 18C and 18D are located on the other longitudinal end part of the plenum chamber casing 17 (along the cylinder row direction). Therefore, the adjoining pairs of branch pipes 18A and 18B located on the one longitudinal end part of the plenum chamber casing 17 slightly diverge away from each other as they extend from the plenum chamber casing 17 to the intake ports 6. Similarly, the adjoining pairs of branch pipes 18C and 18D located on the other longitudinal end part of the plenum chamber casing 17 slightly diverge away from each other as they extend from the plenum chamber casing 17 to the intake ports 6.

The plenum chamber casing 17 is located below the intake port 6. The branch pipes 18 connect the plenum chamber defined in the plenum chamber casing 17 with the corresponding intake ports 6. Each branch pipe 18 has a lower end part 23 connected to a rear side portion (or on upper rear side portion) of the plenum chamber casing 17 on the side facing away from the cylinder block 2 or the rear surface 2A of the cylinder block 2, an intermediate part 24 which is curved so as to face the convex side thereof outward (away from the rear surface 2A of the cylinder block 2), and an upper end part 25 extending substantially orthogonally toward the cylinder head 3 or the rear surface 3A of the cylinder of head 3. Thus, the intermediate parts 24 of the branch pipes protrude away from the rear surface 2A of the cylinder block 2 (in particular, as compared with the upper end parts 25 thereof).

Figure 2:
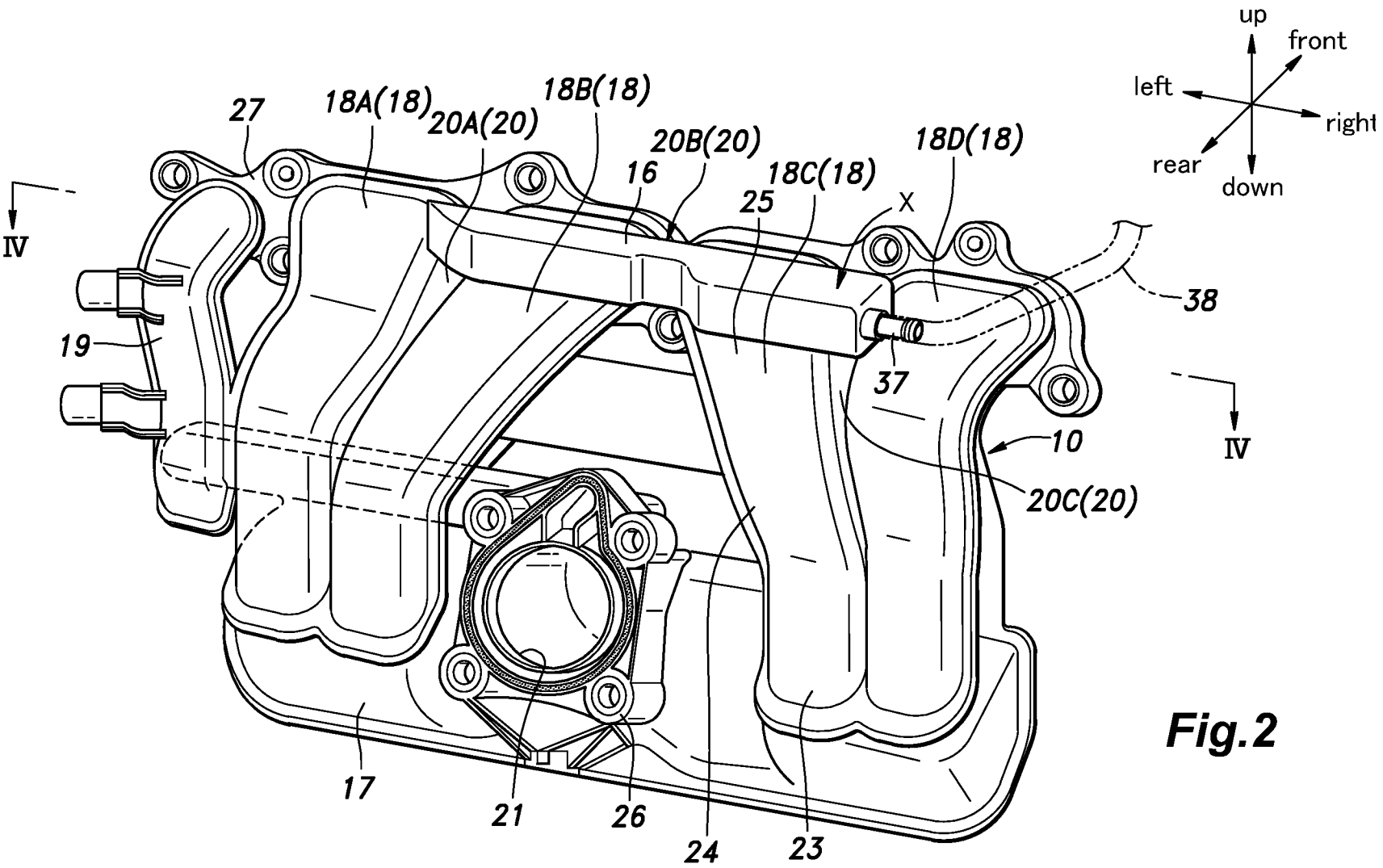
FIG. 2 is a perspective view of an intake manifold structure of the internal combustion engine as viewed from an oblique rearward direction.

The downstream end of the branch pipes 18 are provided with a common fastening flange 27 as shown in FIG. 2. The fastening flange 27 has a front-facing surface (fastening surface), and extends in the cylinder row direction. A flat fastening seat 28 facing rearward is formed on the rear surface 3A of the cylinder head 3 around the intake ports 6. The fastening flange 27 is fastened to the fastening seat 28 with bolts. As a result, the branch pipes 18 are firmly and air-tightly connected to the corresponding intake ports 6.

Figure 3:
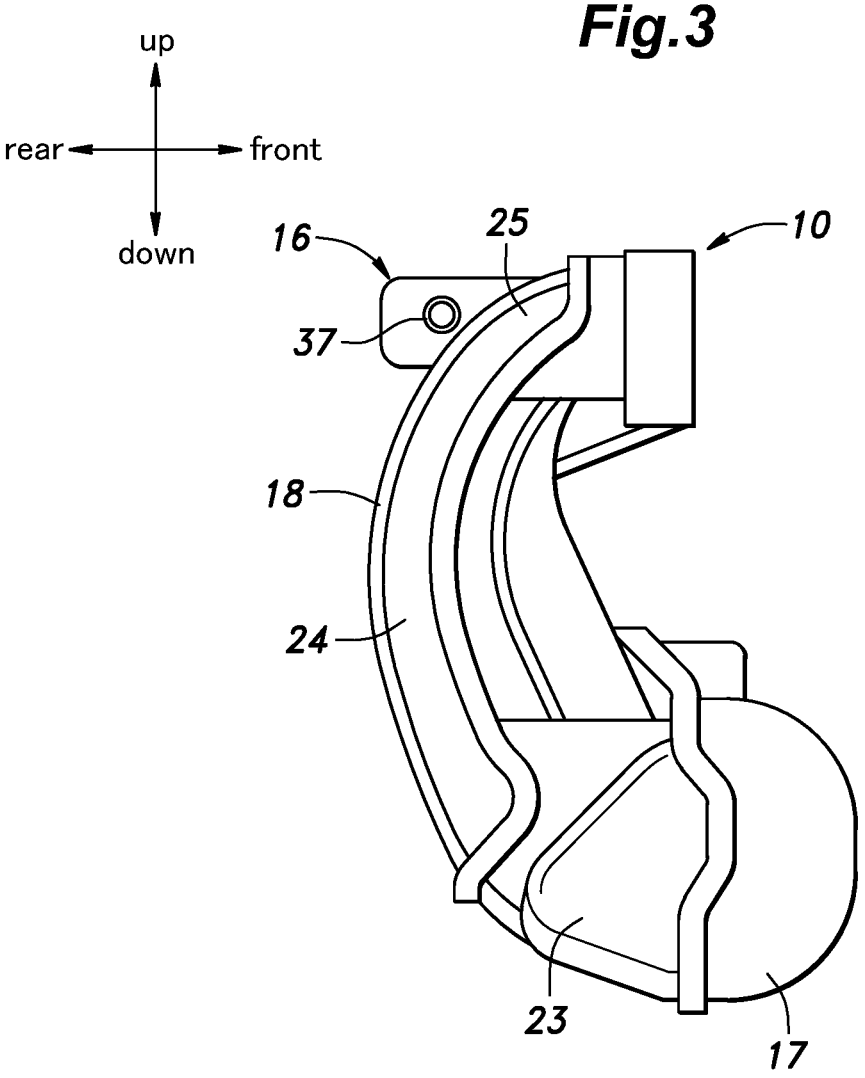
FIG. 3 is a side view of the intake manifold structure.

As shown in FIGS. 2 and 3, the branch pipes 18 are each provided with an additional gas introduction port 29 which is passed through a part of the pipe wall (wall body) of the branch pipe 18 adjacent to the corresponding intake port 6, and communicates with the interior of the branch passage 13 defined in the branch pipe 18. As shown in FIG. 4, two of the additional gas introduction ports 29 on the left hand side are formed in the wall parts of the two branch pipes 18A and 18B (the first branch pipe 18A and the second branch pipe 18B) adjacent to the wall part (the first connecting portion 20A) connecting the two branch pipes 18A and 18B to each other. It can also be said that the two of the additional gas introduction ports 29 on the left hand side are formed in the wall part (the first connecting portion 20A) connecting the two branch pipes 18A and 18B to each other. Similarly, the other two of the additional gas introduction ports 29 on the right hand side are formed in the wall parts of the two branch pipes 18C and 18D (the third branch pipe 18C and the fourth branch pipe 18D) adjacent to the wall part (the third connecting portion 20C) connecting the two branch pipes 18C and 18D to each other. Again, it can also be said that the two of the additional gas introduction ports 29 on the right hand side are formed in the wall part (the first connecting portion 20C) connecting the two branch pipes 18C and 18D to each other. The four additional gas introduction ports 29 are arranged along a line extending in the cylinder row direction.

In this embodiment, the outer wall of the manifold 10 is recessed in the parts thereof between the adjacent branch pipes 18. These parts may also be considered as externally exposed parts of the connecting portions 20. Thus, the outer openings of the additional gas introduction ports 29 are located in these recessed parts of the manifold 10.

The auxiliary pipe 19 internally defines the passage for communicating the crankcase chamber opening 12 with the plenum chamber defined in the plenum chamber casing 17. The auxiliary pipe 19 extends upward from a substantially central part of the upper side of the plenum chamber casing 17 by a short distance, bends leftward along the rear surface 2A of the cylinder block 2, and then extends upward at a left end part of the cylinder block 2 to be connected to the fastening flange 27. Thus, when the fastening flange 27 is fastened to the fastening seat 28, the crankcase chamber opening 12 is communicated with the plenum chamber at the same time as communicating the branch passages 13 with the respective intake ports 6. Thus, the blow-by gas (EGR gas) generated in the crankcase chamber is supplied to the plenum chamber via the auxiliary pipe 19.

The cover member 16 is arranged so as to cover the additional gas introduction ports 29, and is connected to a part of the intake manifold 10 (the branch pipes 18) adjacent to the intake ports 6, or to the upper end parts 25 of the branch pipes 18. In particular, the cover member 16 extends across the branch pipes 18 so as to cover the additional gas introduction ports 29 from the rear.

The cover member 16 is attached to the rear surface of the intake manifold 10 along the peripheral edge thereof so that a gas introduction chamber 34 is defined by the inner surface of the cover member 16 and the opposing outer surface of the intake manifold 10 in an air tight manner. In this embodiment, the cover member 16 is attached to the intake manifold 10 by ultrasonic welding or laser welding.

A blow-by gas introduction port 35 communicating with the gas introduction chamber 34 is formed in a longitudinal end (the right end) of the cover member 16.

Thus, a blow-by gas passage 14 leading to the branch passages 13 is formed by the blow-by gas introduction port 35, the gas introduction chamber 34, and the additional gas introduction ports 29.

To facilitate the introduction of blow-by gas into the blow-by gas introduction port 35, a cylindrical tubular portion 37 is provided on the blow-by gas introduction port 35 so that a piping 38 such as a pipe or a hose may be connected to the cylindrical tubular portion 37 for supplying the blow-gas into the blow-by gas introduction port 35. The other end of the piping 38 is connected to an oil separator 39 provided on top of the head cover 4 for removing oil mist from the blow-by gas drawn from the crankcase chamber, and the blow-by gas from which the oil mist is removed is forwarded to the blow-by gas introduction port 35.

Figure 4:
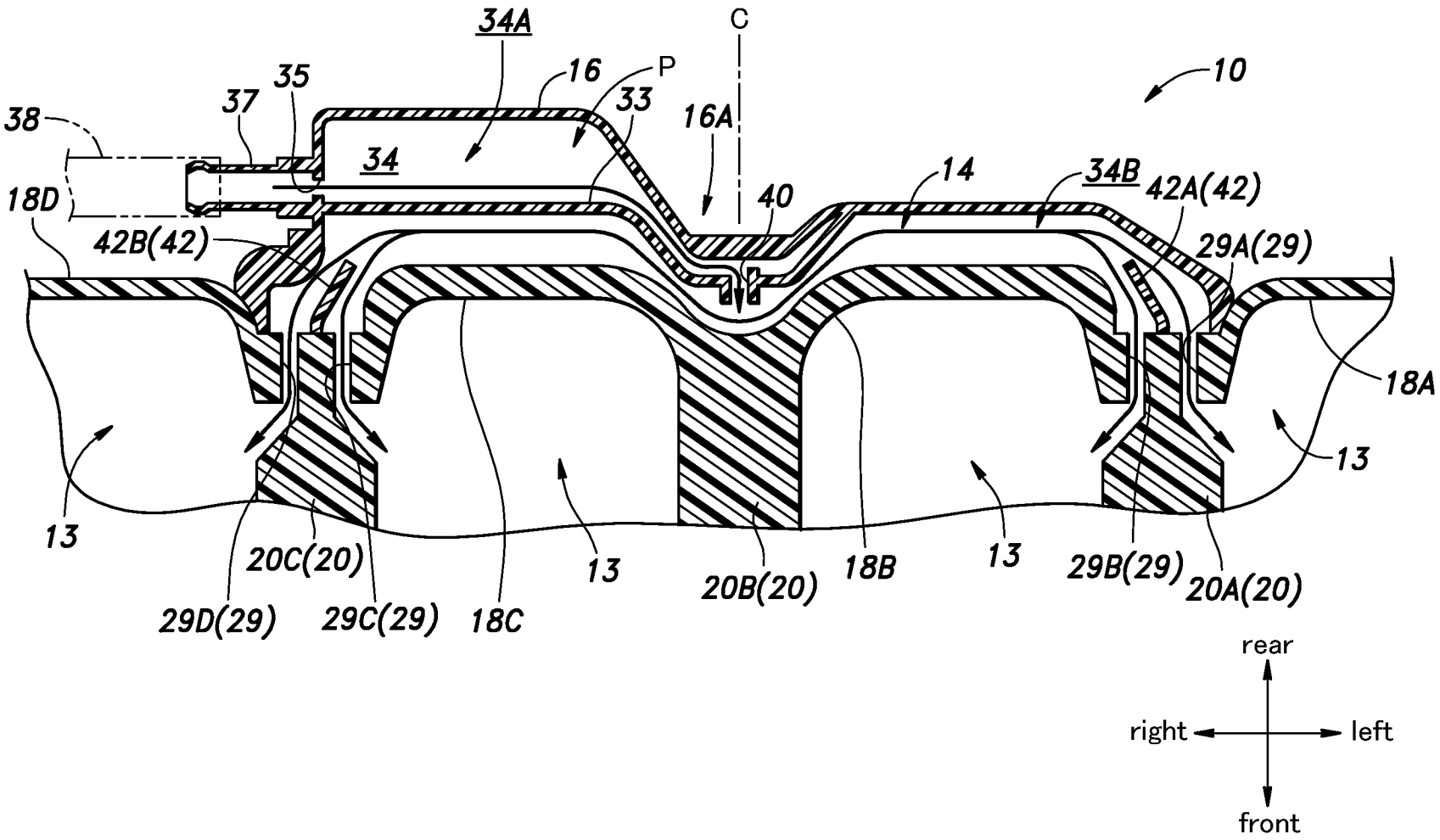
FIG. 4 is a sectional view taken along line IV-IV of FIG. 2.

As shown in FIG. 4, a guide wall 33 is provided inside the gas introduction chamber 34. The guide wall 33 has a plate shape having a major plane facing substantially in the fore and aft direction. The guide wall 33 extends from the longitudinal end wall of the cover member 16 to a part of the outer wall of the cover member 16 located somewhat beyond the longitudinal middle point thereof so that the gas introduction chamber 34 is separated by the guide wall 33 into an upstream chamber 34A and a downstream chamber 34B. Therefore, the upstream chamber 34A is primarily provided in the right half of the cover member 16.

The upstream chamber 34A communicates with the blow-by gas introduction port 35, and the downstream chamber communicates with the additional gas introduction ports 29. The guide wall 33 is provided with a central opening 40 in a longitudinally middle point thereof to communicate the upstream chamber 34A and the downstream chamber 34B with each other.

The cover member 16 bulges more outward (rearward) in the right half part thereof than the left half part thereof so that the upstream chamber 34A defined between the cover member 16 and the guide wall 33 in the right half part of the cover member 16 is maximized in volume without significantly increasing the size of the cover member 16. Furthermore, the right half part of the downstream chamber 34B defined between the guide wall 33 and the outer surface of the intake manifold 10 has a substantially same width (the fore and aft dimension as the vertical dimension) as the left half part of the downstream chamber 34B primarily defined between the cover member 16 and the outer surface of the intake manifold 10. Further, the additional gas introduction ports 29A and 29B of the first branch pipe 18A and the second branch pipe 18B are located in and communicate with the left end part of the downstream chamber 34B, and the additional gas introduction ports 29C and 29D of the third branch pipe 18C and the fourth branch pipe 18D are located in and communicate with the right end part of the downstream chamber 34B.

A projecting wall 42 projects into the downstream chamber 34B from each of the connecting portions 20 (20A and 20C) where the additional gas introduction ports 29 are formed. The projecting wall 42 separates the additional gas introduction ports 29 from each other. The left projecting wall 42A separates the additional gas introduction ports 29 of the two branch pipes 18A and 18B on the left hand side from each other, and the right projecting wall 42B separates the additional gas introduction ports 29 of the two branch pipes 18C and 18D on the left hand side from each other. Each projecting wall 42 is configured to evenly distribute the flow of the blow-by gas between the two mutually adjoining additional gas introduction ports 29.

According to this embodiment, the downstream chamber 34B that provides the additional gas flow passage between the central opening 40 and the different additional gas introduction ports 29 can be formed with a simple structure. In particular, the downstream chamber 34B consists of a single chamber without any partition wall, the structure can be particularly simplified. Since this structure is combined with the projecting walls 42 each projecting from the part of the intake manifold located between the adjoining additional gas introduction ports 29, an even distribution of the additional can be achieved in a particularly favorable manner by using a highly simple structure.

In particular, the projecting walls 42 tilt toward the longitudinal center of the cover member 16 so that the flow length from the central opening 40 may be substantially the same for all of the additional gas introduction ports 29. Further, each of the projecting walls 42 may be integrally molded with the intake manifold 10 as shown in FIG. 4, or alternatively, may be formed separately from the intake manifold 10 and connected to the corresponding connecting portion 20 by using a suitable bonding agent or ultrasonic bonding.

The projecting wall 42A is inclined rightward while the projecting wall 42B is inclined rearward (or toward each other) so as to approach the central opening 40 in each case. As a result, the path lengths (flow path lengths) from the central openings 40 to the respective additional gas introduction ports 29A, 29B, 29C, and 29D are substantially the same. The outlet end of the central opening 40 is provided with a tubular projection so that the velocity component of the gas flow along the cylinder row direction may be removed, and thereby achieve a uniform distribution of the blow-by gas flow.

The mode of the flow of the blow-by gas in the intake manifold 10 is described in the following with reference to FIG. 4. Upon being introduced from the blow-by gas introduction port 35, the blow-by gas advances into the upstream chamber 34A (as indicated by the arrow P in FIG. 4). The blow-by gas that has entered the upstream chamber 34A travels along the flow path P and reaches the longitudinally central part (corresponding to the longitudinal center line C) of the cover member 16 or to the vicinity of the central opening 40 (left end part of the upstream chamber 34A). The blow-by gas then passes through the central opening 40, and enters the downstream chamber 34B. The blow-by gas that has entered the downstream chamber 34B moves forward toward the central connecting portion 20B, and impinges upon a recessed rear surface of the central connecting portion 20B. The blow-by gas then flows obliquely rearward, and evenly distributed between two flows; the leftward flow and the rightward flow. Each of the leftward flow and the rightward flow is then divided into two parts by the corresponding projecting wall 42, and is introduced into the two adjoining additional gas introduction ports 29 again evenly between the two adjoining additional gas introduction ports 29.

Next, the features and advantages of the intake manifold 10 of the illustrated embodiment are discussed in the following. The blow-by gas that has entered from the blow-by gas introduction port 35 is guided to the central portion 16A of the cover member 16 in the cylinder row direction, and is distributed from the central portion 16A to each additional gas introduction port 29. Since the flow path length from the central portion 16A to each additional gas introduction port 29 is uniform (even though the blow-by gas introduction port 35 is provided in the longitudinal end part of the cover member 16), the amounts of the blow-by gas that are distributed to the different additional gas introduction ports 29 can be made substantially equal to one another.

In the present embodiment, the blow-by gas is guided by the guide wall 33 to the central part of the cover member 16 with respect to the cylinder row direction, and the central opening 40 is located in this central part. After passing through the central opening 40, the blow-by gas flows toward the respective additional gas introduction ports 29, and enters the corresponding branch passages 13. The blow-by gas is thus distributed to the additional gas introduction ports 29 in an even manner since the flow path distances from the central opening 40 to the respective additional gas introduction ports 29 (29A-29D) are substantially the same.

By positioning the central opening 40 at the central part with respect to the additional gas introduction ports 29 along the cylinder row direction, the blow-by gas can be distributed to the additional gas introduction ports 29, and thence to the branch passage 13 in an even manner by using a highly simple structure.

The additional gas introduction ports 29 are arranged so as to form closely positioned pairs (two pairs in the case of the in-line four-cylinder engine). Therefore, the flow path of the blow-by gas for each closely positioned pair of the additional gas introduction ports 29 may consist of a single passage that is bifurcated only at the part thereof close to the additional gas introduction ports 29. This allows the flow path structure to be simplified. In this embodiment, the guide wall 33 may have a highly simple structure.

The projecting wall 42 is provided in the connecting portion 20 located between the corresponding closely positioned pair of the additional gas introduction ports 29 which are located between the corresponding branch pipes 18. The additional gas introduction ports 29 are located in the parts of the corresponding branch pipes 18 adjacent to the intake ports 6. Owing to the presence of the projecting walls 42, the flow of the blow-by gas can be evenly divided into different flow paths in a highly stable manner, and an even distribution of the blow-by gas between the different branch passages 13 can be ensured under all operating conditions.

As shown in FIG. 3, the blow-by gas introduced from the blow-by gas introduction port 35 flows into the upstream chamber 34A which has a large cross sectional area and a large volume so that the pressure fluctuations that may be present in the blow-by gas introduced into the upstream chamber 34A via the blow-by gas introduction port 35 is removed as the gas travels through the upstream chamber 34A. Thereby, the smooth operation of the internal combustion engine can be ensured.

The blow-by gas introduction port 35 is provided on one end of the cover member 16 in the cylinder row direction. This facilitates the connection of the piping 38 to the blow-by gas introduction port 35 (the tubular portion 37) as compared with the case where the blow-by gas introduction port 35 is provided at the central position of the cover member 16 in the cylinder row direction. In particular, the piping 38 is prevented from protruding rearward from the internal combustion engine.

Since the cover member 16 is attached to the somewhat upwardly facing surface of the upper end part 25 of the branch pipes 18, the operator can easily visually recognize and access the cover member 16, as compared with the case where the cover member 16 is attached to a downwardly facing surface. In particular, according to the present embodiment, the connection of the piping 38 to the blow-by gas introduction port 35 is facilitated.

The present invention has been described in terms of a specific embodiment, but is not limited in scope by such an embodiment, and can be modified in various ways without departing from the scope of the present invention. For instance, the additional gas introduction ports 29 were provided in the upper end parts of the branch pipes 18 in the foregoing embodiment, but may be provided in any other parts of the branch pipes 18 which may be displaced outward from the opposing surface of the cylinder block 2 or downward from the intake ports 6. The cover member 16 will be positioned so as to correspond to the positions of the additional gas introduction ports 29.

The blow-by gas was introduced into the branch passages 13 as the additional gas in the foregoing embodiments, but may also be a different kind of additional gas such as EGR gas may be introduced into the branch passages 13. The cover member 16 consisted of a single piece member, but may also consist of two or more pieces particularly when the number of cylinders is increased. The cover member 16 consisted of a member separate from the intake manifold 10, but may also be at least partly formed integrally with the intake manifold 10.

The invention claimed is:

1. An intake manifold structure for an internal combustion engine including an intake manifold defining a plurality of branch passages communicating with corresponding intake ports of the internal combustion engine arranged in a cylinder row direction thereof, and provided with additional gas introduction ports communicating with the respective branch passages, and an additional gas introduction passage forming member attached to the intake manifold, and defining an additional gas inlet and additional gas introduction passages communicating the additional gas inlet with the corresponding additional gas introduction ports, wherein the additional gas introduction passage forming member extends across the branch passages, and is provided with a guide wall for defining the additional gas introduction passages in cooperation with an outer surface of the intake manifold and an inner surface of the additional gas introduction passage forming member, wherein the additional gas inlet is formed in an end part of the additional gas introduction passage forming member along the cylinder row direction, wherein an inlet chamber directly communicating with the additional gas inlet and having a certain volume is defined by the guide wall in cooperation with an outer wall of the additional gas introduction passage forming member, wherein the guide wall includes a central opening located in a part thereof corresponding to a central part of the additional gas introduction passage forming member along the cylinder row direction, and communicating a downstream end of the inlet chamber with a part of the additional gas introduction passages leading to the respective additional gas introduction ports, wherein a downstream chamber is defined between the outer wall of the additional gas introduction passage forming member and the guide wall in a region located between the additional gas inlet and the central opening, and between the outer wall of the additional gas introduction passage forming member and the outer surface of the intake manifold in a region located between the central opening and an end part of the additional gas introduction passage forming member remote from the additional gas inlet, wherein each of the branch passages is defined by a respective branch pipe, wherein adjoining branch pipes are connected by a connecting portion, wherein two adjoining gas introduction ports are formed at the connecting portion, wherein a projecting wall projects into the downstream chamber from the connecting portion and is tilted towards the central opening, and wherein the projecting wall is connected to the connecting portion.

2. The intake manifold structure according to claim 1, wherein a tubular projection projects from a periphery of the central opening in a downstream direction.

3. The intake manifold structure according to claim 1, wherein a wall part of the additional gas introduction passage forming member adjoining the additional gas inlet bulges away from the outer surface of the intake manifold.

4. The intake manifold structure according to claim 1, wherein a central part of the additional gas introduction passage forming member along the cylinder row direction substantially coincides with a central part of the intake manifold along the cylinder row direction.

5. The intake manifold structure according to claim 1, wherein the additional gas introduction ports are formed in wall parts of the intake manifold located between adjoining branch passages in a pair so to communicate with the adjoining branch passages, respectively.

6. The intake manifold structure according to claim 1, wherein flow paths extending from the central opening to the respective additional gas introduction ports are substantially identical to one another.

7. The intake manifold structure according to claim 1, wherein the intake manifold curves around the cylinder row direction so as to face a convex side thereof away from a main body of the internal combustion engine, and the additional gas introduction passage forming member is attached to an outer side of a part of the intake manifold adjoining the intake ports.

* * * * *